US010143881B2

(12) United States Patent
Lalaoua

(10) Patent No.: US 10,143,881 B2
(45) Date of Patent: Dec. 4, 2018

(54) MOUNTABLE EXERCISE MACHINE

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 0 days.

(21) Appl. No.: 15/258,047

(22) Filed: Sep. 7, 2016

(65) Prior Publication Data

US 2017/0106227 A1 Apr. 20, 2017

Related U.S. Application Data

(63) Continuation-in-part of application No. 15/204,863, filed on Jul. 7, 2016, now Pat. No. 9,744,401, which is a continuation-in-part of application No. 15/187,564, filed on Jun. 20, 2016, which is a (Continued)

(51) Int. Cl.

| | |
|---|---|
| ***A63B 21/00*** | (2006.01) |
| ***A63B 21/055*** | (2006.01) |
| ***A63B 21/16*** | (2006.01) |
| ***A63B 23/12*** | (2006.01) |
| *A63B 71/06* | (2006.01) |
| *A63B 21/068* | (2006.01) |

(Continued)

(52) U.S. Cl.

CPC ..... *A63B 21/4035* (2015.10); *A63B 21/0552* (2013.01); *A63B 21/16* (2013.01); *A63B 21/4043* (2015.10); *A63B 23/03541* (2013.01); *A63B 23/1209* (2013.01); *A63B 21/00185* (2013.01); *A63B 21/068* (2013.01); *A63B 21/153* (2013.01); *A63B 21/154* (2013.01); *A63B 21/169* (2015.10); *A63B 21/1654* (2013.01); *A63B 21/1663* (2013.01); *A63B 21/4013* (2015.10); *A63B 21/4034* (2015.10); *A63B 23/03508* (2013.01); *A63B 23/03575* (2013.01); *A63B 23/0482* (2013.01); *A63B 71/0622* (2013.01); *A63B 2208/0204* (2013.01); *A63B 2208/029* (2013.01); *A63B 2208/0209* (2013.01)

(58) Field of Classification Search

None

See application file for complete search history.

(56) References Cited

U.S. PATENT DOCUMENTS

| | | | | |
|---|---|---|---|---|
| 7,976,445 | B2 * | 7/2011 | Lalaoua | A63B 21/4005 482/121 |
| 8,840,075 | B2 * | 9/2014 | Dalebout | A63B 21/00065 248/200 |

(Continued)

*Primary Examiner* — Stephen R Crow

(57) ABSTRACT

A mountable exercise machine is a device that is utilized to perform exercises based on elastic resistance and bodyweight. The device includes a first mounting bracket and a second mounting bracket and may be mounted to a door, wall, or similar surface or structure. A first resistance assembly and a second resistance assembly provide elastic resistance when performing exercise. The user is able to grasp a first handle and a second handle when performing upper body exercises. The first resistance assembly and the second resistance assembly may additionally include an ankle strap for performing lower body exercises. At least one harness strap may be utilized to perform suspension and other bodyweight exercises using the device. An upper door bracket and a lower door bracket allow the device to be mounted to a door instead of a wall or similar surface.

8 Claims, 17 Drawing Sheets

Related U.S. Application Data continuation-in-part of application No. PCT/IB2016/005421, filed on Jul. 14, 2016.

(60) Provisional application No. 62/283,839, filed on Sep. 14, 2015, provisional application No. 62/231,629, filed on Jul. 13, 2015.

(51) Int. Cl.
*A63B 23/035* (2006.01)
*A63B 23/04* (2006.01)

(56) References Cited

U.S. PATENT DOCUMENTS

| | | | | |
|---|---|---|---|---|
| 9,028,381 | B2 * | 5/2015 | Mestemaker ..... | A63B 21/0414 482/129 |
| 2017/0106227 | A1 * | 4/2017 | Lalaoua ..... | A63B 21/4035 |

* cited by examiner

MOUNTABLE EXERCISE MACHINE

The current application claims a priority to the U.S. Provisional Patent application Ser. No. 62/283,839 filed on Sep. 14, 2015.

FIELD OF THE INVENTION

The present invention relates generally to an exercise machine. More specifically, the present invention is a mountable exercise machine that is utilized to perform a wide variety of exercises based on elastic resistance and bodyweight.

BACKGROUND OF THE INVENTION

Strength training generally relates to the use of resistance to induce muscular contraction in order to increase the size, anaerobic endurance, and strength of muscles. A wide variety of resistance exercises may be performed, most commonly through weight training utilizing equipment such as dumbbells, barbells, and free weights. Alternatively, bodyweight exercises may be performed in which body weight provides resistance during the exercises. Elastic resistance training generally relates to the use of cable machines. Cable machines include cables to which various types of handle devices may be attached and grasped in order to impart elastic resistance on the user's body during exercises. These types of exercises are often effective for strengthening both primary muscle groups as well as stabilizing muscles.

The present invention is a mountable exercise machine that allows the user to perform a wide variety of elastic resistance and bodyweight exercises. The present invention may be mounted to a door, wall, or similar surface or structure. The present invention allows the user to perform elastic resistance exercises for both the upper body and the lower body. Additionally, the present invention allows the user to perform various suspension and other bodyweight exercises.

DETAIL DESCRIPTIONS OF THE INVENTION

All illustrations of the drawings are for the purpose of describing selected versions of the present invention and are not intended to limit the scope of the present invention.

Figure 1:
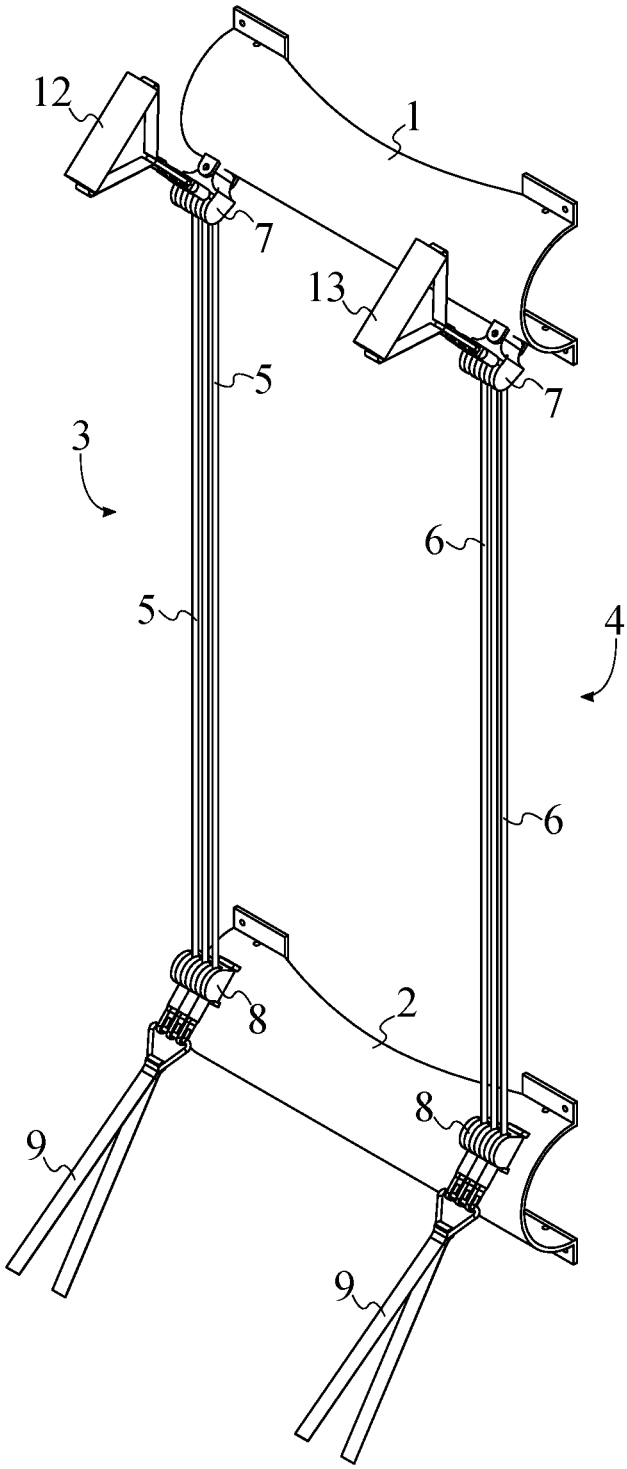
FIG. 1 is a front perspective view of the present invention.
Figure 2:
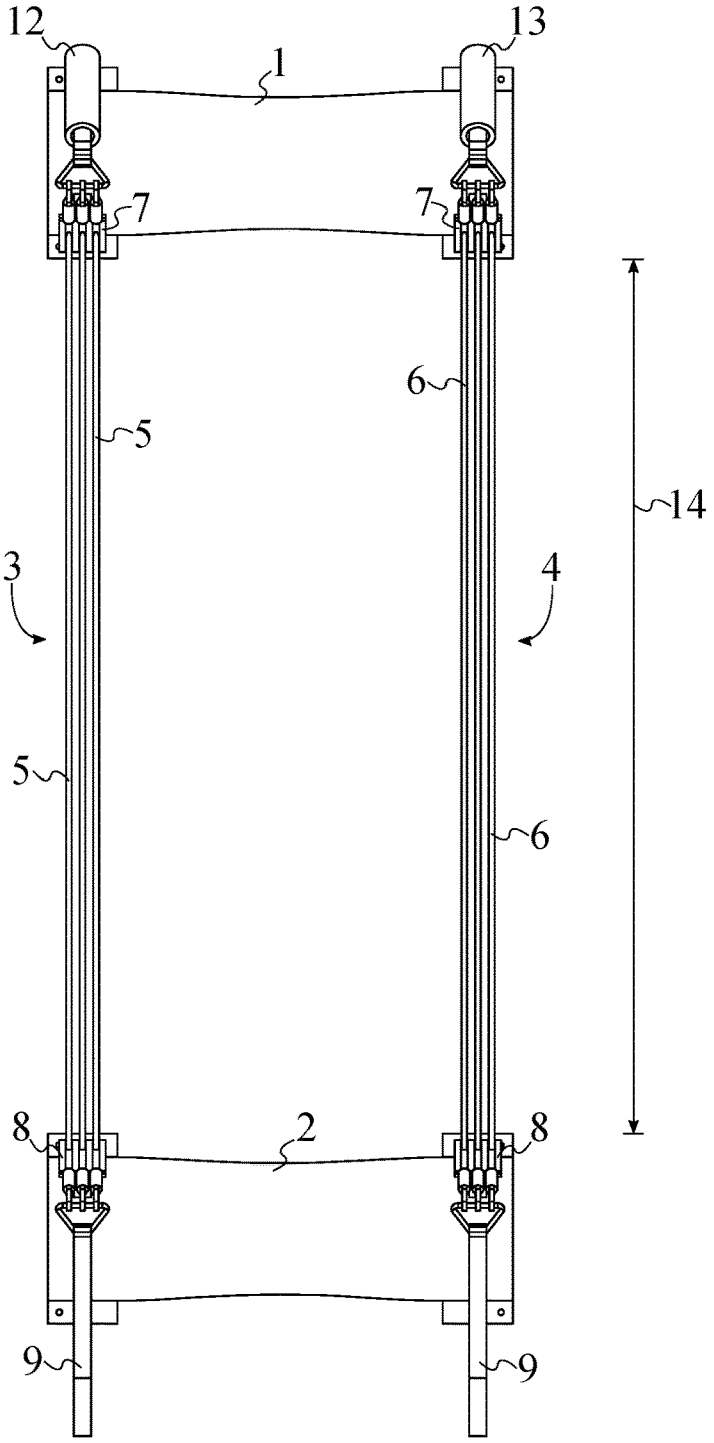
FIG. 2 is a front view of the present invention.

FIG. 1-FIG. 17 provide exemplary implementations of the present invention. The present invention is a mountable exercise machine for use in performing exercises based on elastic resistance and bodyweight. The present invention is shown in FIG. 1 and FIG. 2 and comprises a first mounting bracket 1, a second mounting bracket 2, a first resistance assembly 3, a second resistance assembly 4, a first handle 12, and a second handle 13. An alternative variant of the embodiment of the present invention shown in FIG. 1 and FIG. 2 is shown in FIG. 14.

The first mounting bracket 1 and the second mounting bracket 2 are utilized to mount the present invention to a door, wall, or similar surface or structure. The present invention may be mounted to a floor as well in order increase the variety of exercises that may be performed with the present invention. The first mounting bracket 1 and the second mounting bracket 2 ensure that the present invention does not shift or otherwise move during exercise. In the preferred embodiment of the present invention, the first mounting bracket 1 is tethered to the second mounting bracket 2 in order to provide further stability to the present invention during use. Additionally, the first mounting bracket 1 and the second mounting bracket 2 are offset from each other by a specified distance 14. This allows the present invention to be installed onto a structure such as a door by positioning the first mounting bracket 1 at the top of the door and the second mounting bracket 2 at the bottom of the door. Alternatively, the present invention may be installed onto a wall or similar surface by offsetting the second mounting bracket 2 from the first mounting bracket 1 on the wall. The first mounting bracket 1 and the second mounting bracket 2 may include foam padding to prevent damage to the surface onto which the first mounting bracket 1 and the second mounting bracket 2 are secured.

The first resistance assembly 3 and the second resistance assembly 4 are utilized to provide elastic resistance for strength training when utilizing the present invention. The first resistance assembly 3 is tethered to the first mounting bracket 1 while the second resistance assembly 4 is tethered to the first mounting bracket 1, opposite to the first resistance assembly 3. This allows the first resistance assembly 3 and the second resistance assembly 4 to provide balanced resistance to the user's body while the user is exercising. For example, the first resistance assembly 3 is able to provide resistance to the left side of the user's body while the second resistance assembly 4 is able to provide resistance to the right side of the user's body. The first handle 12 and the second handle 13 may be grasped by the user's hands when performing exercises. The first handle 12 is removably tethered to the first resistance assembly 3 while the second handle 13 is removably tethered to the second resistance assembly 4. As a result, resistance is imparted on the user's body by the first resistance assembly 3 and the second resistance assembly 4 when the user grasps the first handle 12 and the second handle 13 when performing exercises. The first handle 12 and the second handle 13 may be removed from the first resistance assembly 3 and the second resistance assembly 4 and replaced with an alternative handle device.

In the embodiment of the present invention shown in FIG. 1 and FIG. 2, the first resistance assembly 3 and the second resistance assembly 4 each comprise a first plurality of elastic cables 5, a second plurality of elastic cables 6, a first pulley assembly 7, and a second pulley assembly 8. The first plurality of elastic cables 5 and the second plurality of elastic cables 6 provide elastic resistance for strength training. The first pulley assembly 7 and the second pulley assembly 8 allow the user to perform exercises by drawing on and releasing the first plurality of elastic cables 5 and the second plurality of elastic cables 6. The first pulley assembly 7 and the second pulley assembly 8 additionally provide freedom of movement and adjustability to the first plurality of elastic cables 5 and the second plurality of elastic cables 6. The first pulley assembly 7 of the first resistance assembly 3 is pivotally mounted to the first mounting bracket 1 while the second pulley assembly 8 of the first resistance assembly 3 is pivotally mounted to the second mounting bracket 2. Similarly, the first pulley assembly 7 of the second resistance assembly 4 is pivotally mounted to the first mounting bracket 1, opposite to the first pulley assembly 7 of the first resistance assembly 3 and the second pulley assembly 8 of the second resistance assembly 4 is pivotally mounted to the second mounting bracket 2, opposite to the second pulley assembly 8 of the first resistance assembly 3. This allows the first pulley assembly 7 and the second pulley assembly 8 of both the first resistance assembly 3 and the second resistance assembly 4 to pivot and otherwise adjust during exercises based on the user's movement. The specific design and mechanism of the first pulley assembly 7 and the second pulley assembly 8 may vary across embodiments of the present invention.

The first plurality of elastic cables 5 is tensionably engaged about the first pulley assembly 7 of the first resistance assembly 3 and the second pulley assembly 8 of the first resistance assembly 3. As a result, the first pulley assembly 7 and the second pulley assembly 8 of the first resistance assembly 3 enable the first plurality of elastic cables 5 to be drawn and released by the user by rotating the first pulley assembly 7 and the second pulley assembly 8 of the first resistance assembly 3. The second plurality of elastic cables 6 is tensionably engaged about the first pulley assembly 7 of the second resistance assembly 4 and the second pulley assembly 8 of the second resistance assembly 4. The first pulley assembly 7 and the second pulley assembly 8 of the second resistance assembly 4 thus allow the second plurality of elastic cables 6 to be drawn and released by the user by rotating the first pulley assembly 7 and the second pulley assembly 8 of the second resistance assembly 4.

The first handle 12 is terminally connected to each cable from the first plurality of elastic cables 5 while the second handle 13 is terminally connected to each cable from the second plurality of elastic cables 6. The first handle 12 and the second handle 13 may thus be grasped and pulled or released when performing exercises. The specific number of cables for the first plurality of elastic cables 5 and the second plurality of elastic cables 6 may vary across embodiments of the present invention.

The first resistance assembly 3 and the second resistance assembly 4 each further comprise an ankle strap 9. The ankle strap 9 of the first resistance assembly 3 and the ankle strap 9 of the second resistance assembly 4 are utilized to secure the user's legs to the first plurality of elastic cables 5 and the second plurality of elastic cables 6. As a result, the ankle strap 9 allows the user to perform lower body exercises using the present invention in addition to upper body exercises through the first handle 12 and the second handle 13. The ankle strap 9 of the first resistance assembly 3 is terminally connected to each cable from the first plurality of elastic cables 5, opposite to the first handle 12. Similarly, the ankle strap 9 of the second resistance assembly 4 is terminally connected to each cable from the second plurality of elastic cables 6, opposite to the second handle 13. The ankle strap 9 of the first resistance assembly 3 and the ankle strap 9 of the second resistance assembly 4 are thus positioned offset from the first handle 12 and the second handle 13, allowing the user to perform lower body exercises. In the preferred embodiment of the present invention, the ankle strap 9 of the first resistance assembly 3 may be secured to the user's left leg while the ankle strap 9 of the second resistance assembly 4 may be secured to the user's right leg.

Figure 3:
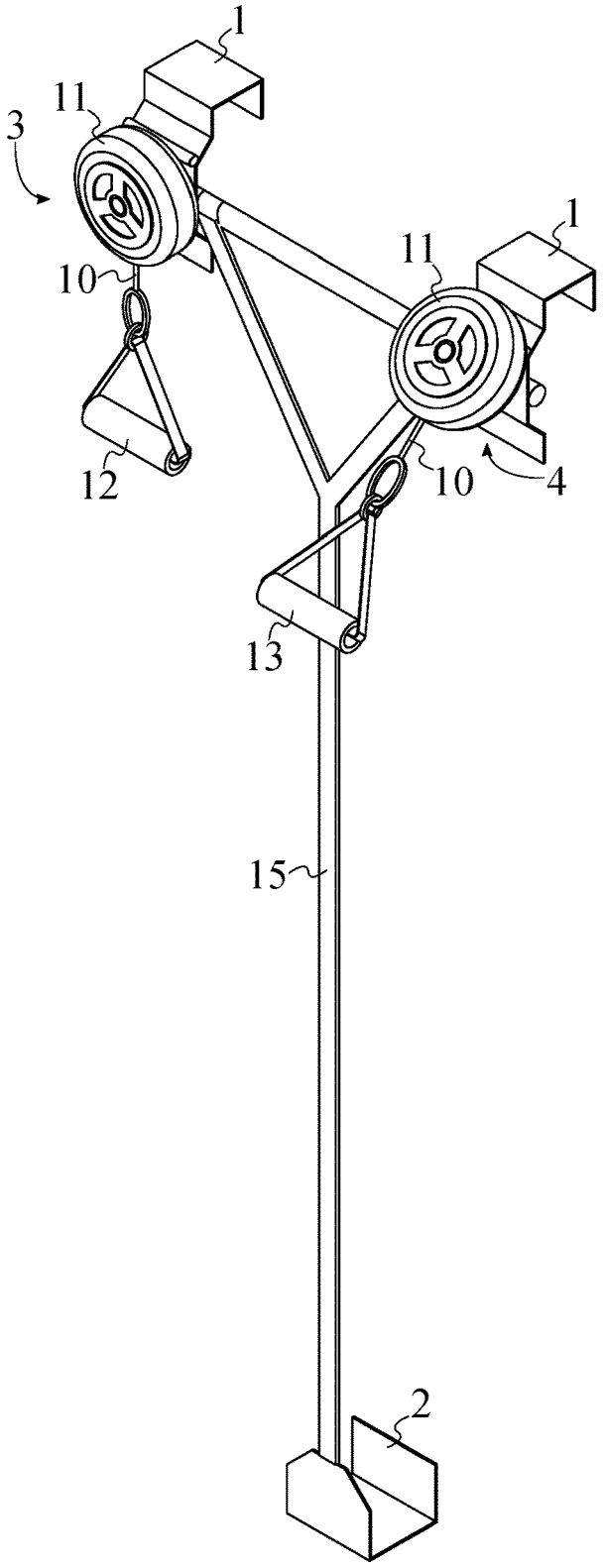
FIG. 3 is a perspective view of an alternative embodiment of the present invention with the securing strap.
Figure 4:
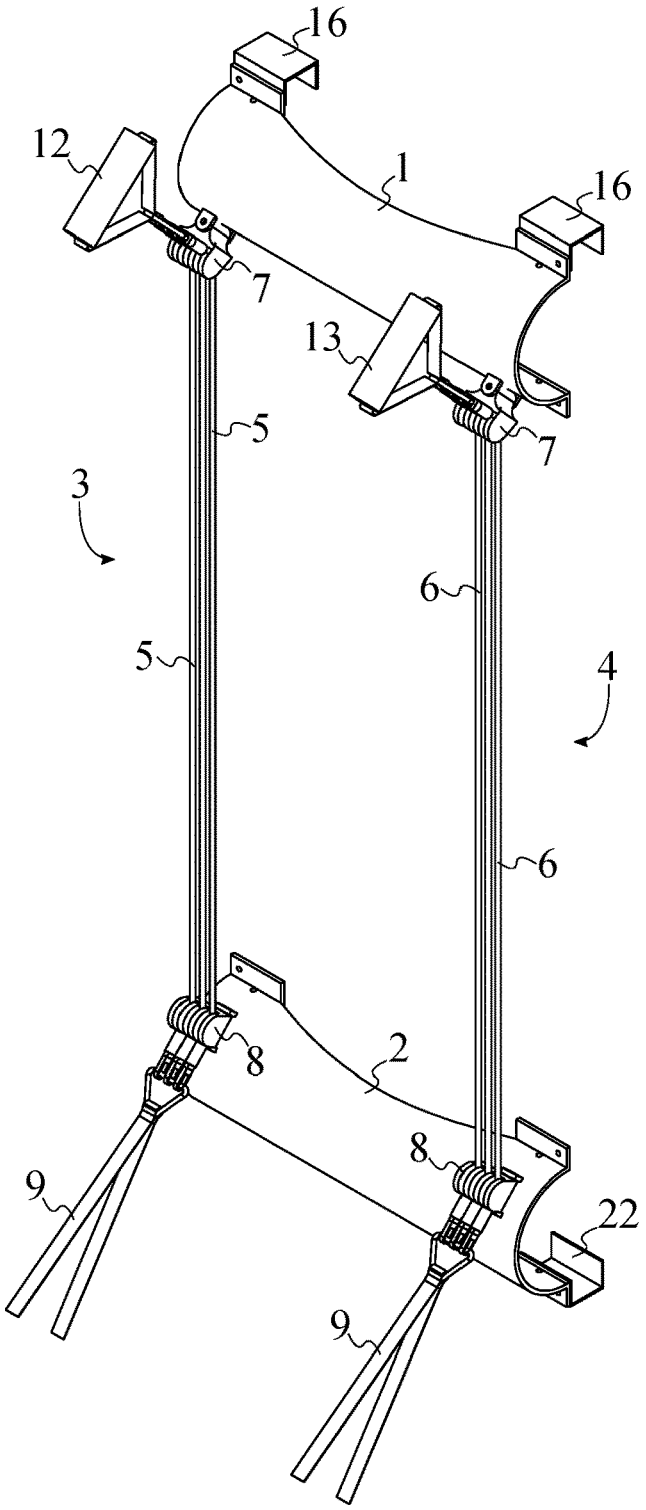
FIG. 4 is a front perspective view of an alternative of the present invention with the upper door bracket and the lower door bracket.
Figure 5:
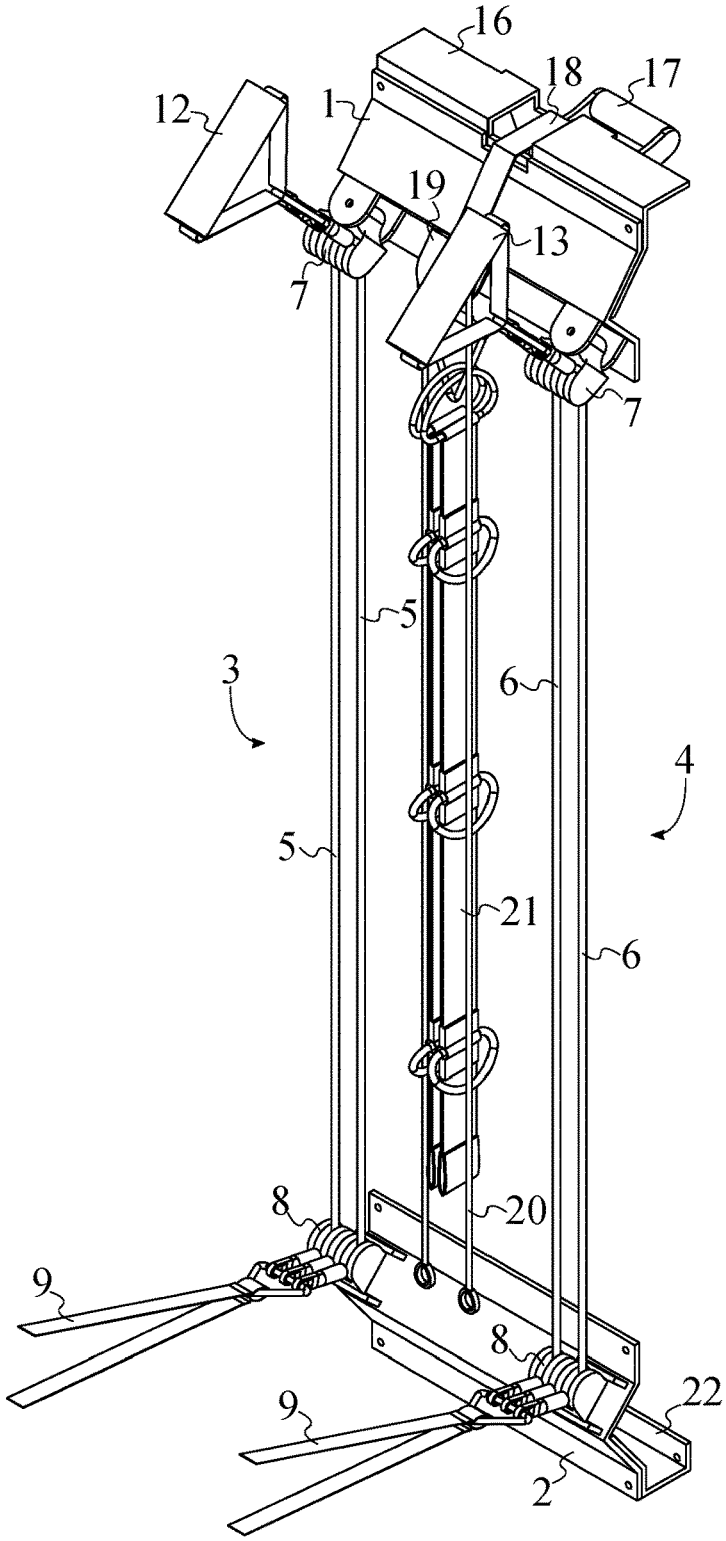
FIG. 5 is a front perspective view of an alternative embodiment of the present invention with additional exercise options and a removable upper door bracket and lower door bracket.
Figure 6:
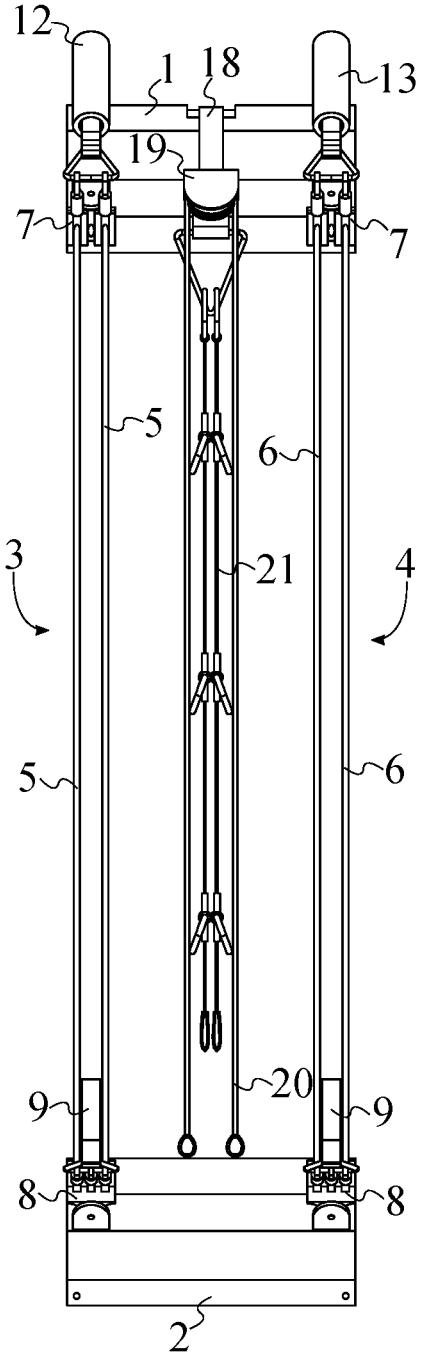
FIG. 6 is a front view of the alternative embodiment of the present invention from FIG. 5.
Figure 7:
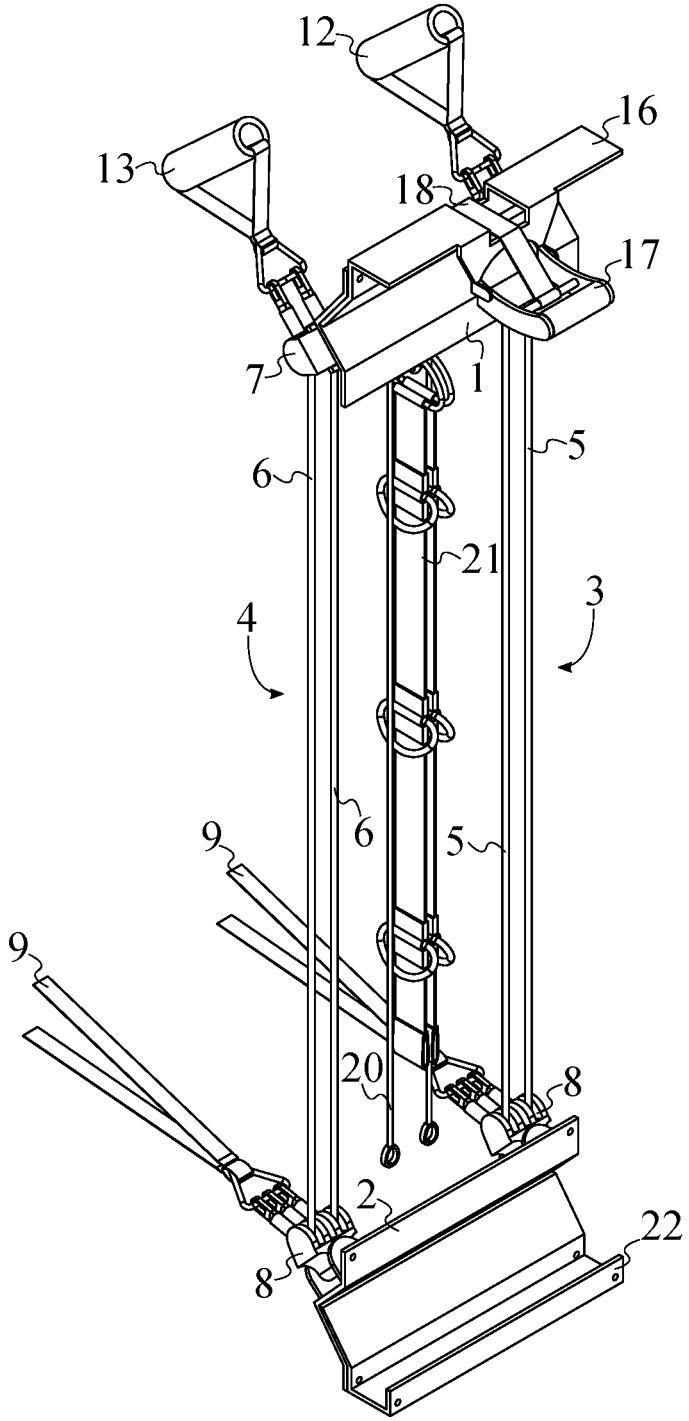
FIG. 7 is a rear perspective view of the alternative embodiment of the present invention from FIG. 5.
Figure 8:
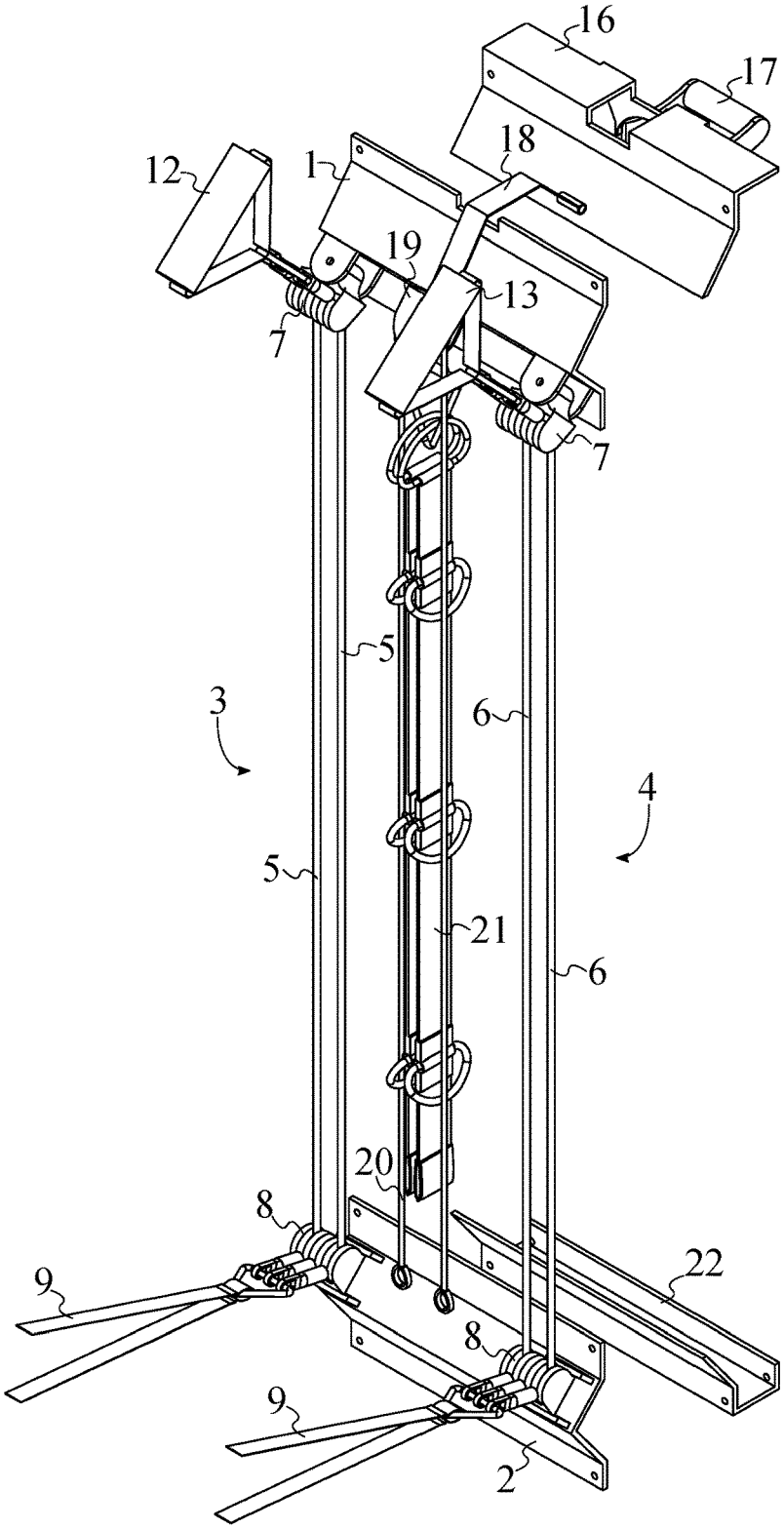
FIG. 8 is a front exploded perspective view of the alternative embodiment of the present invention from FIG. 5.
Figure 9:
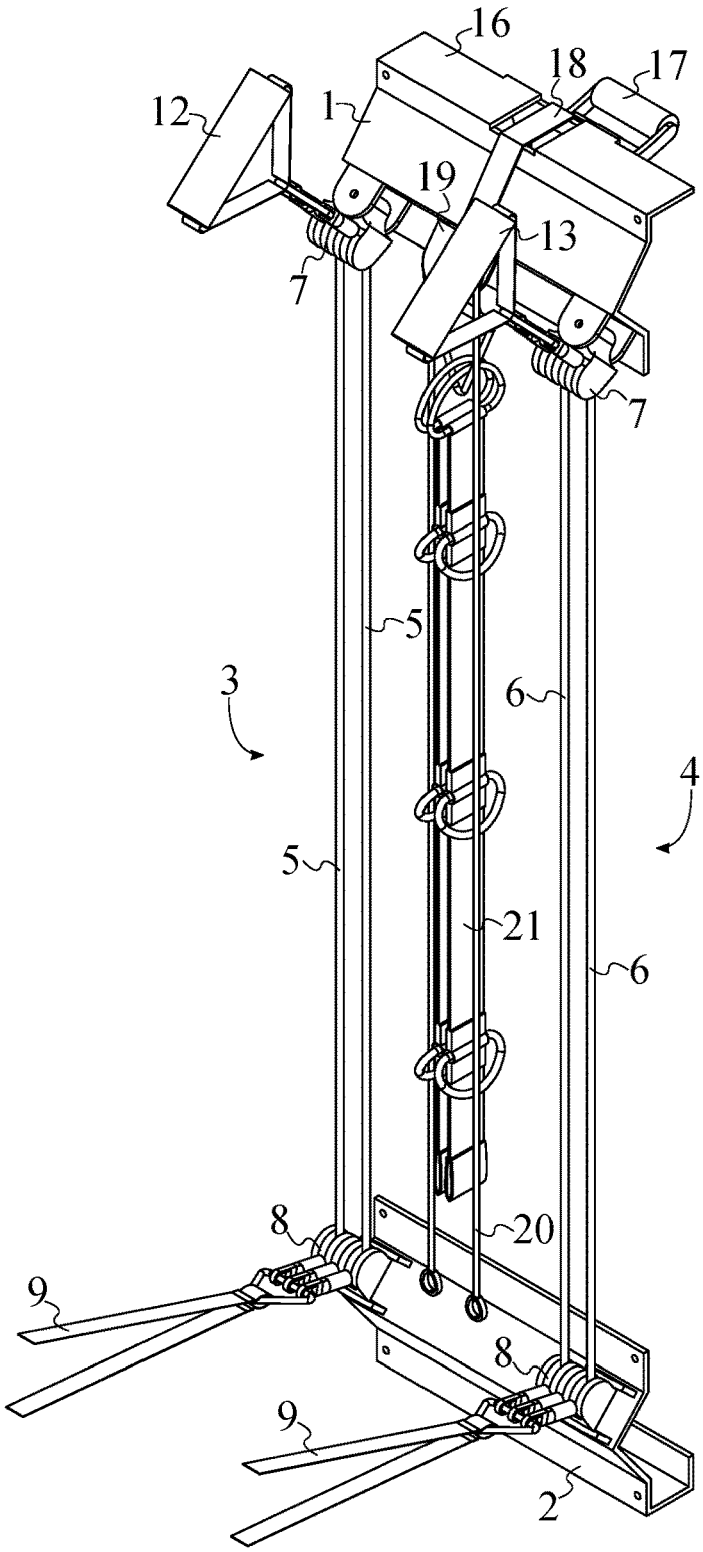
FIG. 9 is a front perspective view of an alternative embodiment of the present invention with additional exercise options and an integrated upper door bracket and lower door bracket.

The embodiment of the present invention shown in FIG. 3 further comprises a securing strap 15. The securing strap 15 is utilized to tether the first mounting bracket 1 and the second mounting bracket 2 to each other. The first mounting bracket 1 is terminally connected to the securing strap 15 while the second mounting bracket 2 is terminally connected to the securing strap 15, opposite to the first mounting bracket 1. In this embodiment of the present invention, the securing strap 15 tethers the second mounting bracket 2 to the first mounting bracket 1 in lieu of the first plurality of elastic cables 5 and the second plurality of elastic cables 6.

With further reference to the embodiment of the present invention shown in FIG. 3, the first resistance assembly 3 and the second resistance assembly 4 each further comprise a retractable cable 10 and a retractable cable housing 11. This embodiment of the present invention may be attached to the top or the bottom of a door. The retractable cable 10 and the retractable cable housing 11 are utilized in lieu of the first plurality of elastic cables 5 and the second plurality of elastic cables 6 to provide elastic resistance when performing exercises. The retractable cable housing 11 of the first resistance assembly 3 is hingedly connected to the first mounting bracket 1 while the retractable cable housing 11 of the second resistance assembly 4 is hingedly connected to the first mounting bracket 1, opposite to the retractable cable housing 11 of the first resistance assembly 3. In the preferred embodiment of the present invention, a hinged and spring-loaded connection is utilized. The retractable cable housing 11 of the first resistance assembly 3 and the retractable cable housing 11 of the second resistance assembly 4 are thus able to provide balanced resistance to the user's body when performing exercises. Additionally, the retractable cable housing 11 of the first resistance assembly 3 and the retractable cable housing 11 of the second resistance assembly 4 are able to pivot and otherwise adjust during exercises based on the user's movement. The retractable cable 10 is retractably engaged into the retractable cable housing 11. This allows the retractable cable 10 to be drawn out of and into the retractable cable housing 11 during exercises, providing elastic resistance to the user's body. The first handle 12 is terminally and removably tethered to the retractable cable 10 of the first resistance assembly 3 while the second handle 13 is terminally and removably tethered to the retractable cable 10 of the second resistance assembly 4. Resistance is thus imparted on the user's body by the retractable cable 10 of the first resistance assembly 3 and the retractable cable 10 of the second resistance assembly 4 when the user grasps the first handle 12 and the second handle 13. The first handle 12 and the second handle 13 may be removed from the retractable cable 10 of the first resistance assembly 3 and the retractable cable 10 of the second resistance assembly 4 and replaced with an alternative handle device.

The embodiments of the present invention shown in FIGS. 4-9 and 16-17 further comprise an upper door bracket 16. The upper door bracket 16 enables the first mounting bracket 1 to be secured to the top of a door. The upper door bracket 16 is mounted along the first mounting bracket 1 in order to provide stability to the first mounting bracket 1 when the first mounting bracket 1 is mounted to a door. The upper door bracket 16 is oriented away from the first resistance assembly 3 and the second resistance assembly 4. This positions the first resistance assembly 3 and the second resistance assembly 4 along a door's planar surface when the first mounting bracket 1 is secured to the door. In the embodiment of the present invention shown in FIGS. 5-8 and 17, the upper door bracket 16 is removably mounted to the first mounting bracket 1. This enables the first mounting bracket 1 to be mounted to a wall or a door as desired by the user. Alternatively, the upper door bracket 16 may be integrated with the first mounting bracket 1 as shown in the embodiment of the present invention shown in FIGS. 9 and 16. The upper door bracket 16 may include foam padding to prevent damage to the door.

With further reference to the embodiments of the present invention shown in FIGS. 4-9, the embodiments of the present invention shown further comprise a lower door bracket 22. Similar to the upper door bracket 16, the lower door bracket 22 is utilized to secure the first mounting bracket 1 to the bottom of a door. The lower door bracket 22 is mounted along the second mounting bracket 2 and provides stability to the second mounting bracket 2 when the second mounting bracket 2 is mounted to a door. The lower door bracket 22 is oriented away from the first resistance assembly 3 and the second resistance assembly 4. The first resistance assembly 3 and the second resistance assembly 4 are thus positioned along a door's planar surface when the second mounting bracket 2 is secured to the door. In the embodiment of the present invention shown in FIGS. 5-8, the lower door bracket 22 is removably mounted to the second mounting bracket 2, enabling the second mounting bracket 2 to be mounted to a wall or a door as desired by the user. Alternatively, the lower door bracket 22 may be integrated with the second mounting bracket 2 as shown in the embodiment of the present invention shown in FIG. 9. As with the upper door bracket 16, the lower door bracket 22 may include foam padding to prevent damage to the door.

With continued reference to FIGS. 5-9, these embodiments of the present invention further comprise a strap anchor 17, a pulley strap 18, a standalone pulley 19, a standalone cable 20, and at least one harness strap 21. The standalone pulley 19 and the standalone cable 20 provide the user with additional exercise options in addition to the first resistance assembly 3 and the second resistance assembly 4. The pulley strap 18 tethers the standalone pulley 19 to the strap anchor 17 while the strap anchor 17 is utilized to secure the pulley strap 18 in place, providing stability to the standalone pulley 19. The at least one harness strap 21 provides even further exercise options when utilizing the present invention by allowing the user to perform suspension exercises to strengthen the core.

The strap anchor 17 is centrally and pivotally connected to the upper door bracket 16, opposite to the first resistance assembly 3 and the second resistance assembly 4. The strap anchor 17 is thus positioned on the opposite side of the door on which the first resistance assembly 3 and the second resistance assembly 4 are located. The strap anchor 17 is hingedly moved into place against the doorframe in order to lock the standalone pulley 19, the pulley strap 18, and the standalone cable 20 in place. The strap anchor 17 is automatically positioned against the doorframe when the user draws on the at least one harness strap 21. In the preferred embodiment of the present invention, the strap anchor 17 includes foam padding to prevent damage to the doorframe. The standalone pulley 19 is positioned in between the first resistance assembly 3 and the second resistance assembly 4. The central positioning of the standalone pulley 19 ensures resistance is provided evenly when the user is utilizing the standalone cable 20 during exercises. The standalone pulley 19 is tethered to the strap anchor 17 by the pulley strap 18. As a result, the standalone pulley 19 is secured in place on the present invention on the strap anchor 17, preventing the standalone pulley 19 from separating from the strap anchor 17. The pulley strap 18 enables the standalone pulley 19 to be positioned on the opposite side of the door as the strap anchor 17. The standalone cable 20 is tensionably engaged about the standalone pulley 19. The standalone pulley 19 is thus rotated when the standalone cable 20 is pulled and released by the user during exercises. The at least one harness strap 21 is removably connected to the standalone pulley 19. The standalone pulley 19 serves as the mounting point for the at least one harness strap 21 and ensures that the user is able to perform suspension and other exercises safely utilizing the at least one harness strap 21.

Figure 10:
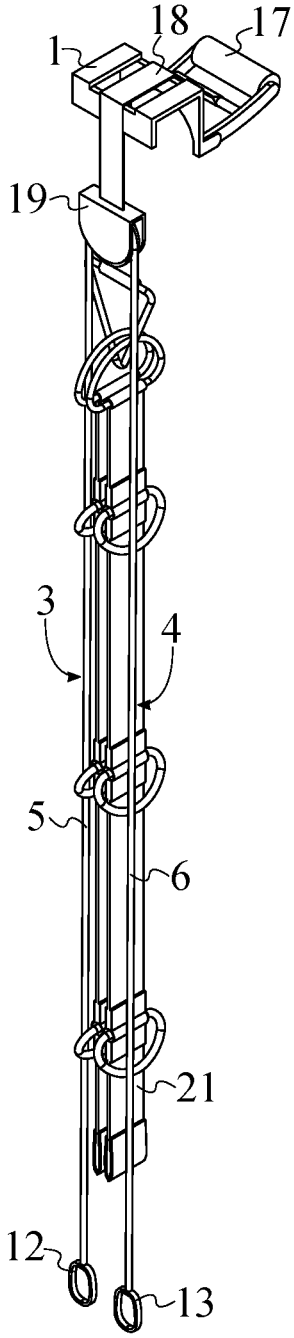
FIG. 10 is a front perspective view of an alternative embodiment of the present invention with the lower door bracket, the first plurality of elastic cables, and the second plurality of elastic cables removed.

The alternative embodiment of the present invention shown in FIG. 10 is designed for use when mounted to only the top of a door. This embodiment of the present invention may be utilized without the second mounting bracket 2. Additionally, the first plurality of elastic cables 5 and the second plurality of elastic cables 6 may be removed from this embodiment of the present invention.

Figure 11:
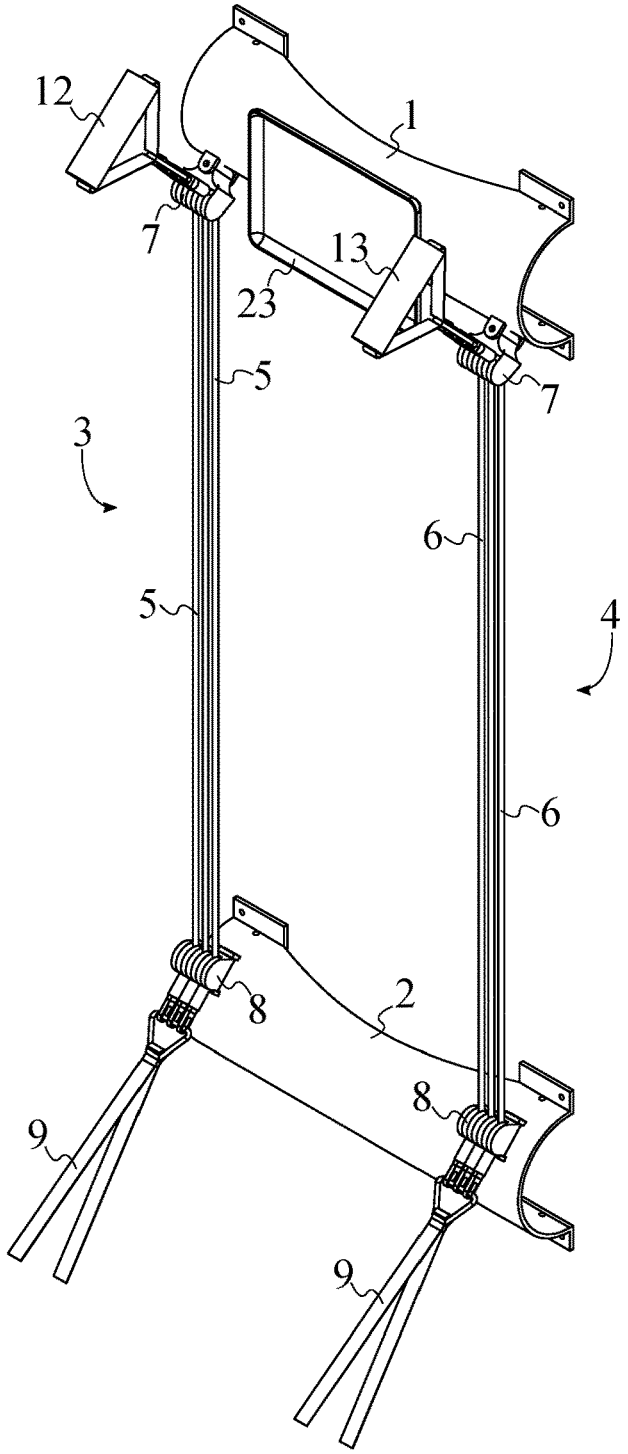
FIG. 11 is a front perspective view of an alternative embodiment of the present invention with the electronic display mount.

The embodiment of the present invention shown in FIG. 11 further comprises an electronic display mount 23. The electronic display mount 23 allows an electronic device such as a tablet computer to be utilized along with the present invention. As a result, the user may view exercise program videos or other types of media while exercising. The electronic display mount 23 is connected to the first mounting bracket 1, in between the first resistance assembly 3 and the second resistance assembly 4. As a result, the electronic display mount 23 is positioned near the top portion of the door or wall to which the present invention is mounted. Alternatively, the electronic display mount 23 may be connected to the second mounting bracket 2, positioning the electronic display mount 23 at a lower elevation.

Figure 12:
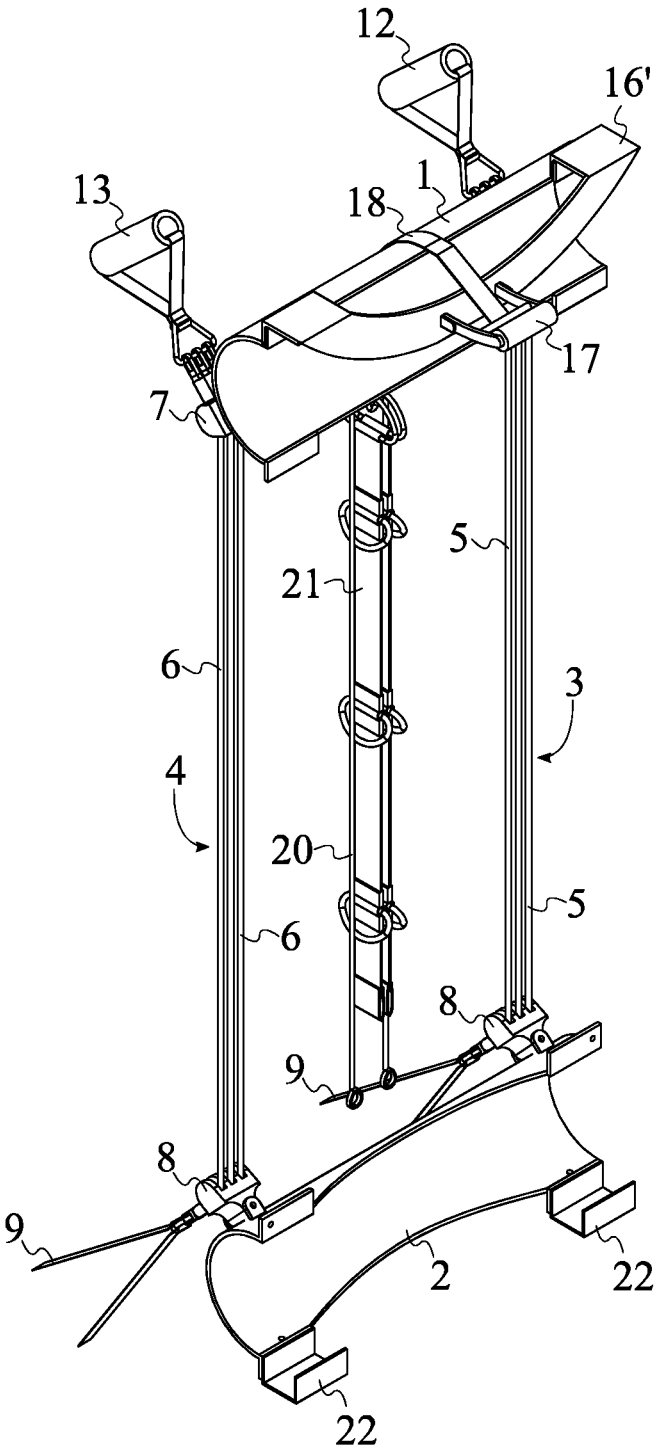
FIG. 12 is a rear perspective view of an alternative embodiment of the present invention with an alternate upper door bracket.
Figure 13:
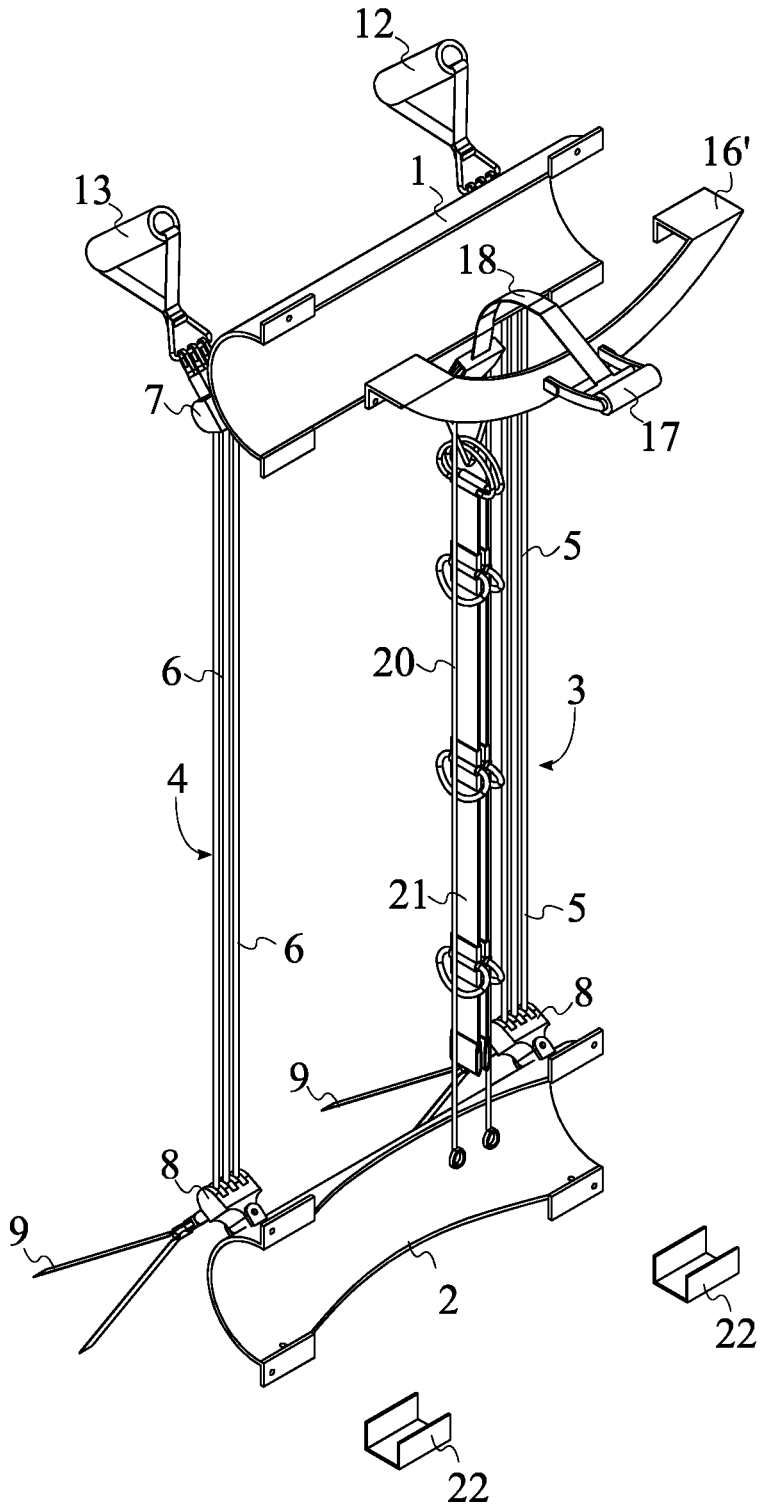
FIG. 13 is a rear exploded perspective view of an alternative embodiment of the present invention with an alternate upper door bracket.
Figure 14:
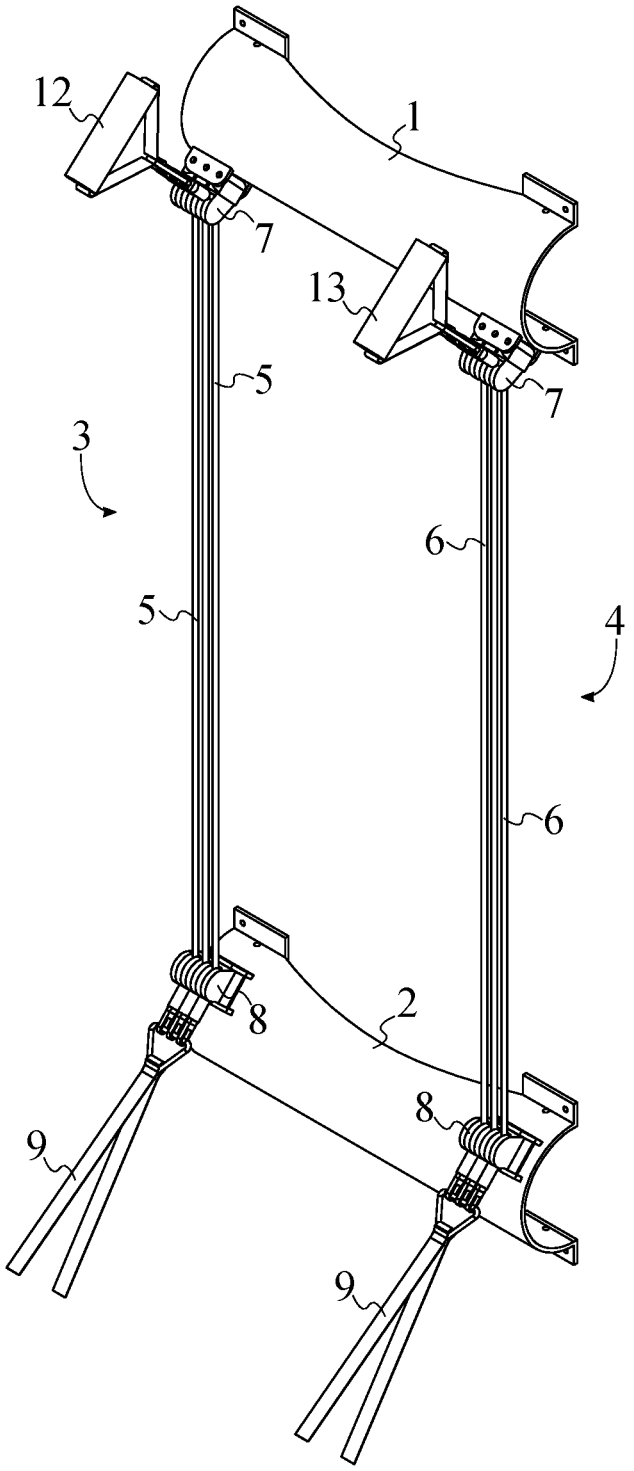
FIG. 14 is a front perspective view of an alternative variant of the embodiment of the present invention shown in FIG. 1.
Figure 15:
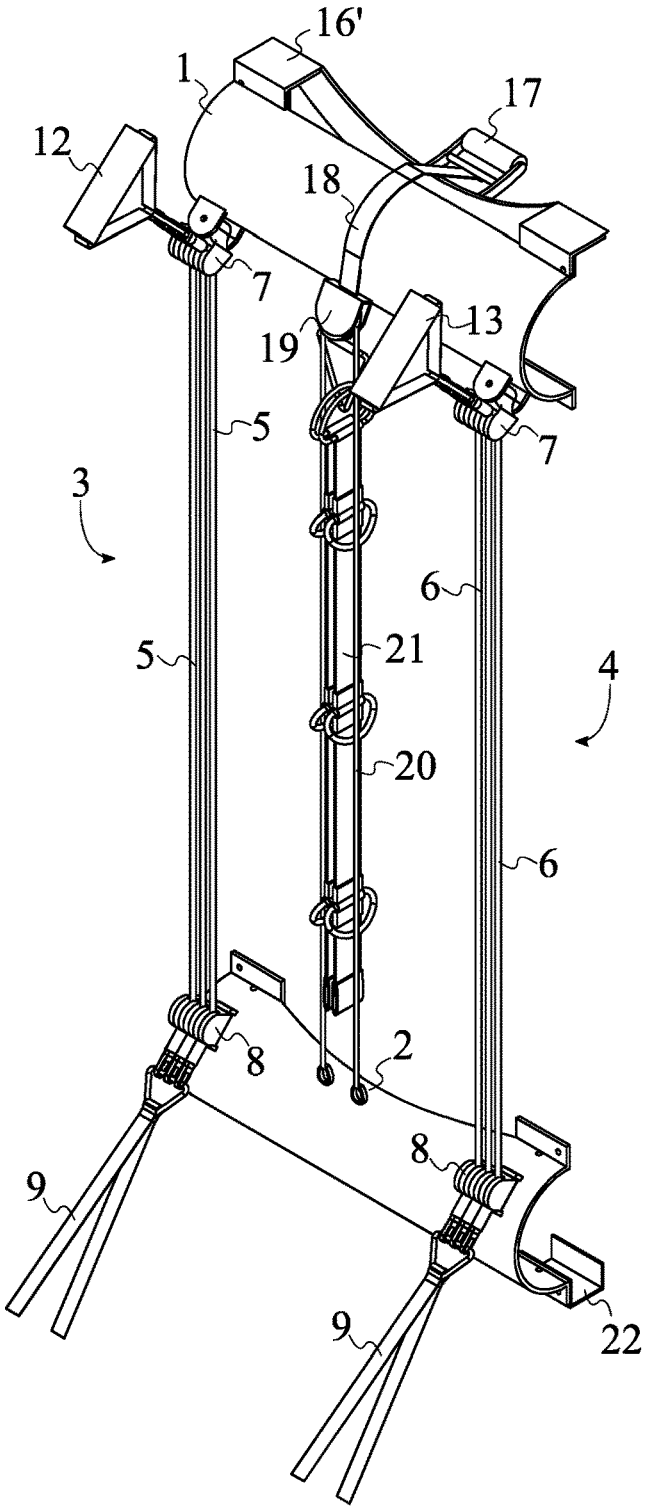
FIG. 15 is a front perspective view of the alternative embodiment of the present invention from FIG. 12.
Figure 16:
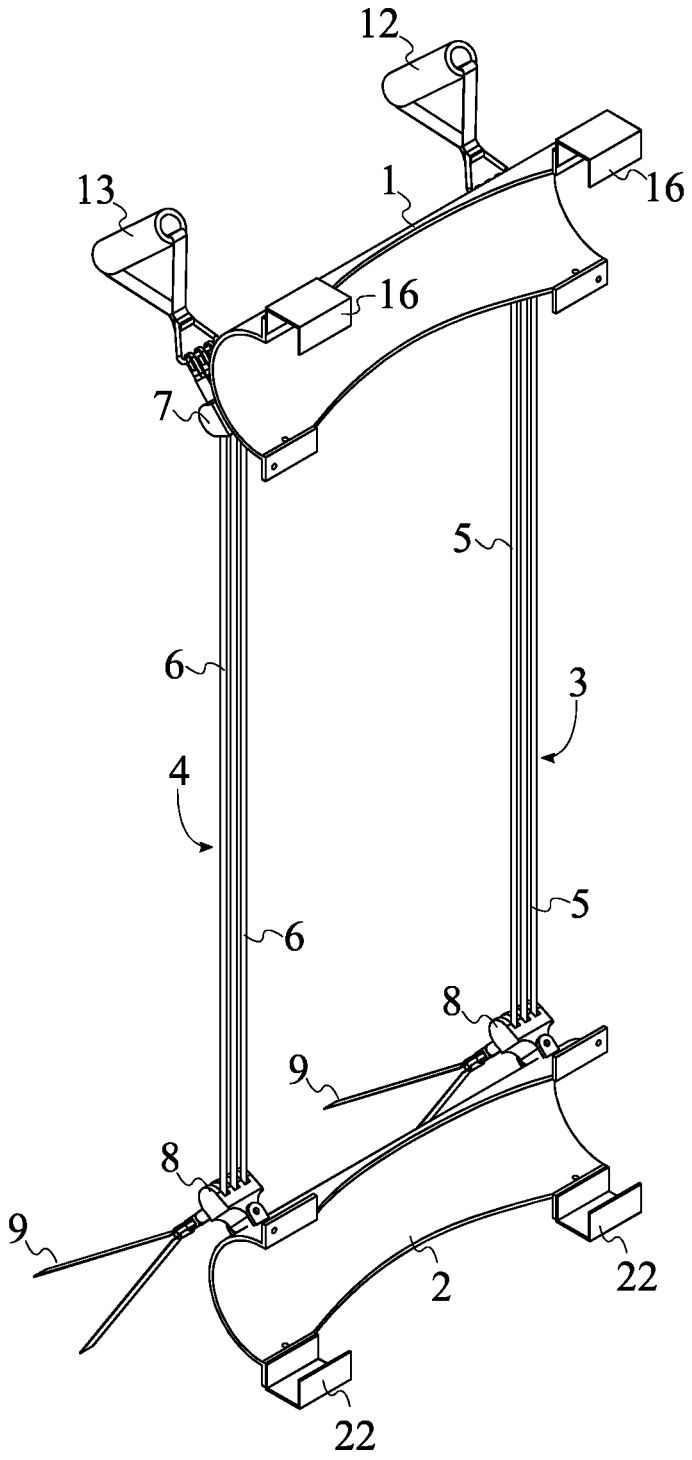
FIG. 16 is a rear perspective view of the alternative of the present invention from FIG. 4.
Figure 17:
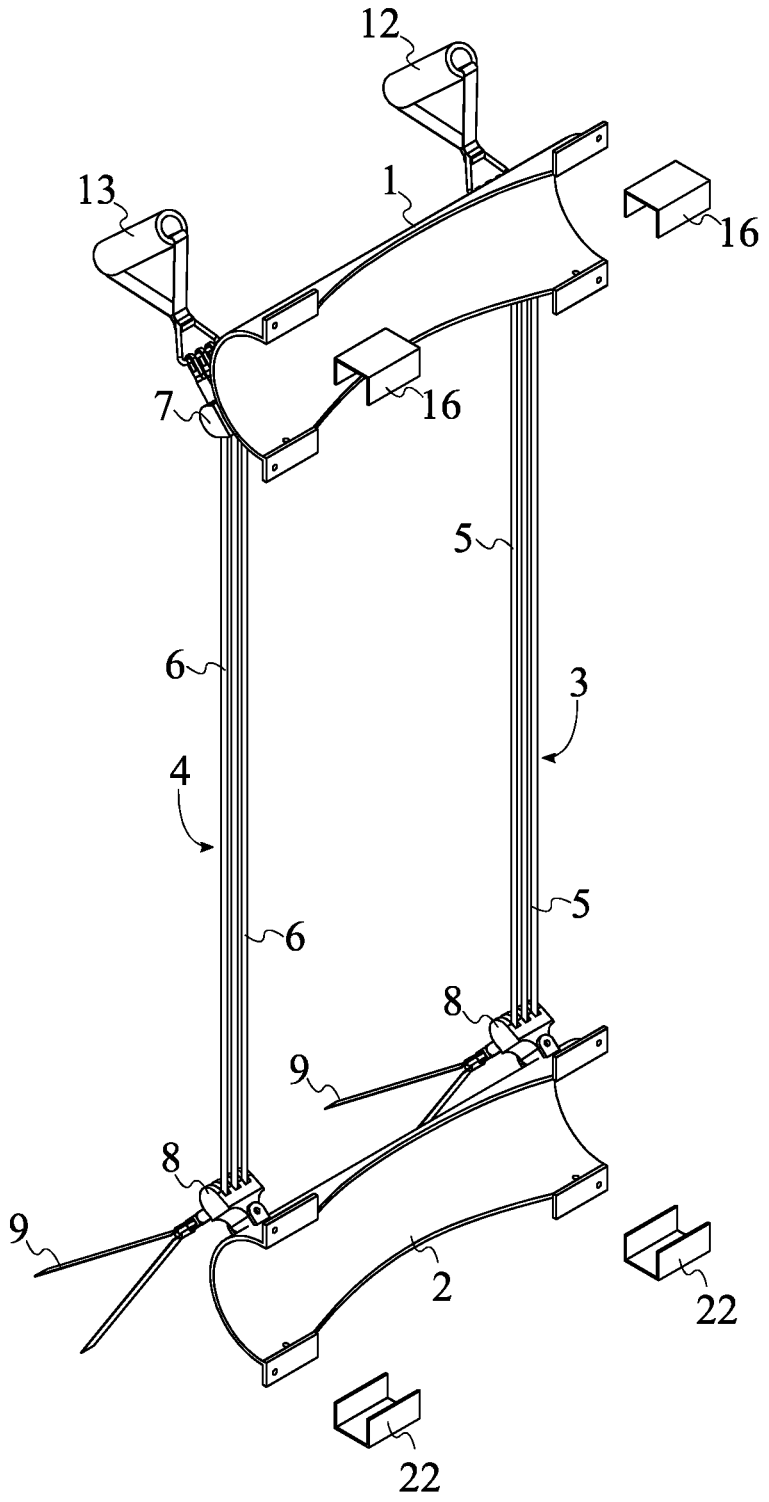
FIG. 17 is a rear exploded perspective view of the alternative of the present invention from FIG. 4.

Further alternative embodiments of the present invention are shown in FIG. 12 and FIG. 13 and FIG. 15. These alternative embodiments of the present invention feature alternative versions of the upper door bracket 16'.

Although the present invention has been explained in relation to its preferred embodiment, it is understood that many other possible modifications and variations can be made without departing from the spirit and scope of the present invention as hereinafter claimed.

What is claimed is:

1. A mountable exercise machine comprises:

a first mounting bracket;

a second mounting bracket;

a first resistance assembly;

a second resistance assembly;

a first handle;

a second handle;

the first mounting bracket being tethered to the second mounting bracket;

the first mounting bracket and the second mounting bracket being offset from each other by a specified distance;

the first resistance assembly being tethered to the first mounting bracket;

the second resistance assembly being tethered to the first mounting bracket, opposite to the first resistance assembly;

the first handle being removably tethered to the first resistance assembly;

the second handle being removably tethered to the second resistance assembly;

an upper door bracket;

the upper door bracket being mounted along the first mounting bracket;

the upper door bracket being oriented away from the first resistance assembly and the second resistance assembly;

a strap anchor;

a pulley strap;

a standalone pulley;

a standalone cable;

at least one harness strap;

the strap anchor being centrally and pivotally connected to the upper door bracket, opposite to the first resistance assembly and the second resistance assembly;

the standalone pulley being positioned in between the first resistance assembly and the second resistance assembly;

the standalone pulley being tethered to the strap anchor by the pulley strap;

the standalone cable being tensionably engaged about the standalone pulley; and the at least one harness strap being removably connected to the standalone pulley.

2. The mountable exercise machine as claimed in claim 1 further comprises:

the first resistance assembly and the second resistance assembly each comprise a first plurality of elastic cables, a second plurality of elastic cables, a first pulley assembly, and a second pulley assembly;

the first pulley assembly of the first resistance assembly being pivotally mounted to the first mounting bracket;

the second pulley assembly of the first resistance assembly being pivotally mounted to the second mounting bracket;

the first pulley assembly of the second resistance assembly being pivotally mounted to the first mounting bracket, opposite to the first pulley assembly of the first resistance assembly;

the second pulley assembly of the second resistance assembly being pivotally mounted to the second mounting bracket, opposite to the second pulley assembly of the first resistance assembly;

the first plurality of elastic cables being tensionably engaged about the first pulley assembly of the first resistance assembly and the second pulley assembly of the first resistance assembly;

the second plurality of elastic cables being tensionably engaged about the first pulley assembly of the second resistance assembly and the second pulley assembly of the second resistance assembly;

the first handle being terminally connected to each cable from the first plurality of elastic cables; and the second handle being terminally connected to each cable from the second plurality of elastic cables.

3. The mountable exercise machined as claimed in claim 2 further comprises:

the first resistance assembly and the second resistance assembly each further comprise an ankle strap;

the ankle strap of the first resistance assembly being terminally connected to each cable from the first plurality of elastic cables, opposite to the first handle; and the ankle strap of the second resistance assembly being terminally connected to each cable from the second plurality of elastic cables, opposite to the second handle.

4. The mountable exercise machine as claimed in claim 1 further comprises:

a securing strap;

the first mounting bracket being terminally connected to the securing strap; and the second mounting bracket being terminally connected to the securing strap, opposite to the first mounting bracket.

5. The mountable exercise machine as claimed in claim 1 further comprises:

the first resistance assembly and the second resistance assembly each comprise a retractable cable and a retractable cable housing;

the retractable cable housing of the first resistance assembly being hingedly connected to the first mounting bracket;

the retractable cable housing of the second resistance assembly being hingedly connected to the first mounting bracket, opposite to the retractable cable housing of the first resistance assembly;

the retractable cable being retractably engaged into the retractable cable housing;

the first handle being terminally and removably tethered to the retractable cable of the first resistance assembly; and the second handle being terminally and removably tethered to the retractable cable of the second resistance assembly.

6. The mountable exercise machine as claimed in claim 1 further comprises:

a lower door bracket;

the lower door bracket being mounted along the second mounting bracket; and the lower door bracket being oriented away from the first resistance assembly and the second resistance assembly.

7. The mountable exercise machine as claimed in claim 6 further comprises:

the lower door bracket being removably mounted to the second mounting bracket.

8. The mountable exercise machine as claimed in claim 1 further comprises:

an electronic display mount; and the electronic display mount being connected to the first mounting bracket, in between the first resistance assembly and the second resistance assembly.

* * * * *